US010750274B2

(12) United States Patent
Wu et al.

(10) Patent No.: US 10,750,274 B2
(45) **Date of Patent: *Aug. 18, 2020**

(54) SPEAKER BOX

(71) Applicant: AAC Technologies Pte. Ltd., Singapore (SG)

(72) Inventors: Jun Wu, Shenzhen (CN); Kaihua Shen, Shenzhen (CN); Yue Ren, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/525,542

(22) Filed: Jul. 29, 2019

(65) Prior Publication Data

US 2020/0045408 A1 Feb. 6, 2020

(30) Foreign Application Priority Data

Aug. 2, 2018 (CN) ..... 2018 1 0872997

(51) Int. Cl.
*H04R 1/02* (2006.01)
*H04R 1/28* (2006.01)
*H04R 9/06* (2006.01)

(52) U.S. Cl.
CPC ..... *H04R 1/288* (2013.01); *H04R 1/021* (2013.01); *H04R 9/06* (2013.01); *H04R 2400/11* (2013.01); *H04R 2499/11* (2013.01)

(58) Field of Classification Search
CPC ..... H04R 9/06; H04R 1/288; H04R 1/021; H04R 2400/11; H04R 2499/11; H04R 9/02; H04R 1/02
USPC ..... 381/332, 386, 90, FOR. 139, 334, 335, 381/336, 357
See application file for complete search history.

(56) References Cited

U.S. PATENT DOCUMENTS

2018/0020273 A1* 1/2018 Li ..... H04R 1/02

FOREIGN PATENT DOCUMENTS

CN 207070332 * 3/2018 ..... H04R 9/02
CN 207460510 * 6/2018 ..... H04R 9/06

* cited by examiner

*Primary Examiner* — Vivian C Chin
*Assistant Examiner* — Ubachukwu A Odunukwe
(74) *Attorney, Agent, or Firm* — W&G Law Group LLP

(57) ABSTRACT

A speaker box is provided in the present disclosure. The speaker box comprises a shell, a speaker, a sound guiding channel, an auxiliary sound cavity, a baffle, a cover plate and a sound absorber. The diaphragm of the speaker separates the receiving space into a front sound cavity and a rear cavity, the sound guiding channel communicates the front sound cavity with the outside. The auxiliary sound cavity is provided with the first through hole communicating with the front cavity and the second through hole communicating with the outside, and the baffle completely covers the first through hole. The baffle is provided with a channel, and the auxiliary sound cavity communicates with the front cavity through the channel. The cover plate covers the second through hole. Compared with the related art, the high frequency acoustic performance of the speaker box of the present disclosure is excellent.

8 Claims, 3 Drawing Sheets

SPEAKER BOX

FIELD OF THE DISCLOSURE

The present disclosure relates to electro-acoustic transducers, and more particularly to a speaker box used in a portable electronic device, like a mobile phone.

DESCRIPTION OF RELATED ART

With the arrival of the mobile internet era, the amount of the smart mobile equipment is increasing. However, among many types of mobile equipment, mobile phones undoubtedly are the most common and most portable mobile terminal equipment. At present, there are diverse functions of the mobile phone, and one of the important functions is the high-quality music function. Therefore, the speaker boxes used to play sounds are widely applied to current smart mobile equipment.

The speaker box of the related art comprises a shell having a receiving space, a speaker accommodated in the shell and a sound guiding channel formed in the receiving space of the shell. The speaker comprises a diaphragm for vibrating and radiating sound, which separates the receiving space into a front sound cavity and a rear cavity. The front vocal cavity communicates with the outside via the sound guiding channel, and the sound guiding channel and the front sound cavity jointly constitute a front cavity.

However, in the speaker box of the related art, the space of the front cavity is limited to the area opposite to the dome and the region of the sound guiding channel, so the structure is monotonous and unsuitable for optimal design, the high frequency acoustical performance is limited. Excessive high frequency response leads to harsh sound, sharp lip sound and teeth sound, and other poor sound performance.

Therefore, it is desired to provide a speaker box to overcome the aforesaid problems.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
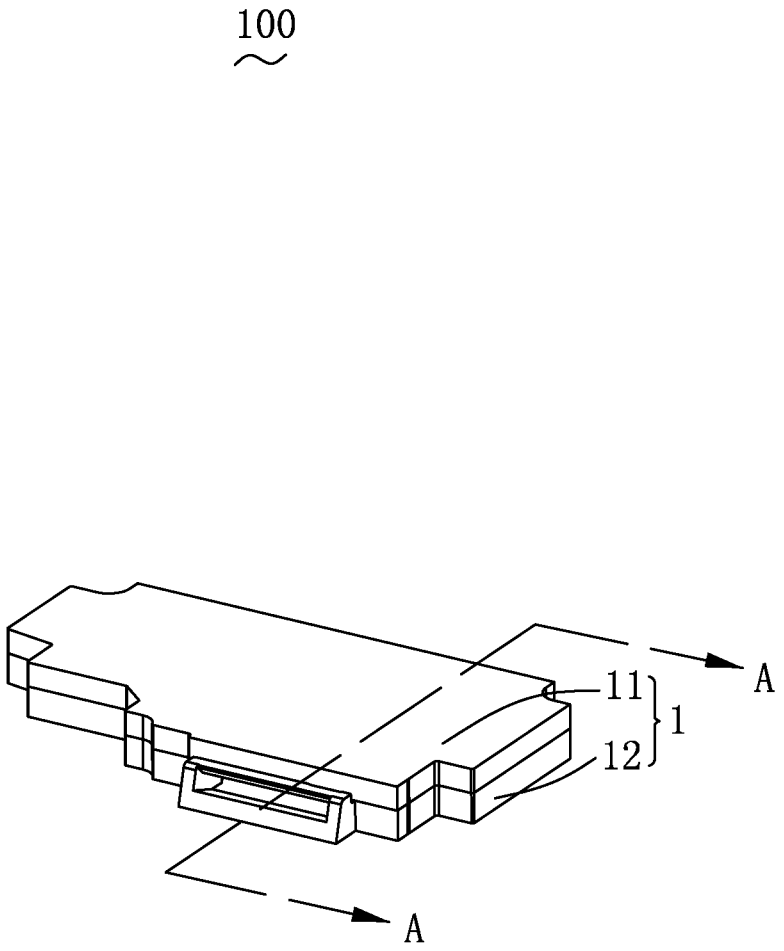
FIG. 1 is a three-dimensional structure diagram of the speaker box in accordance with an exemplary embodiment of the present disclosure.
Figure 2:
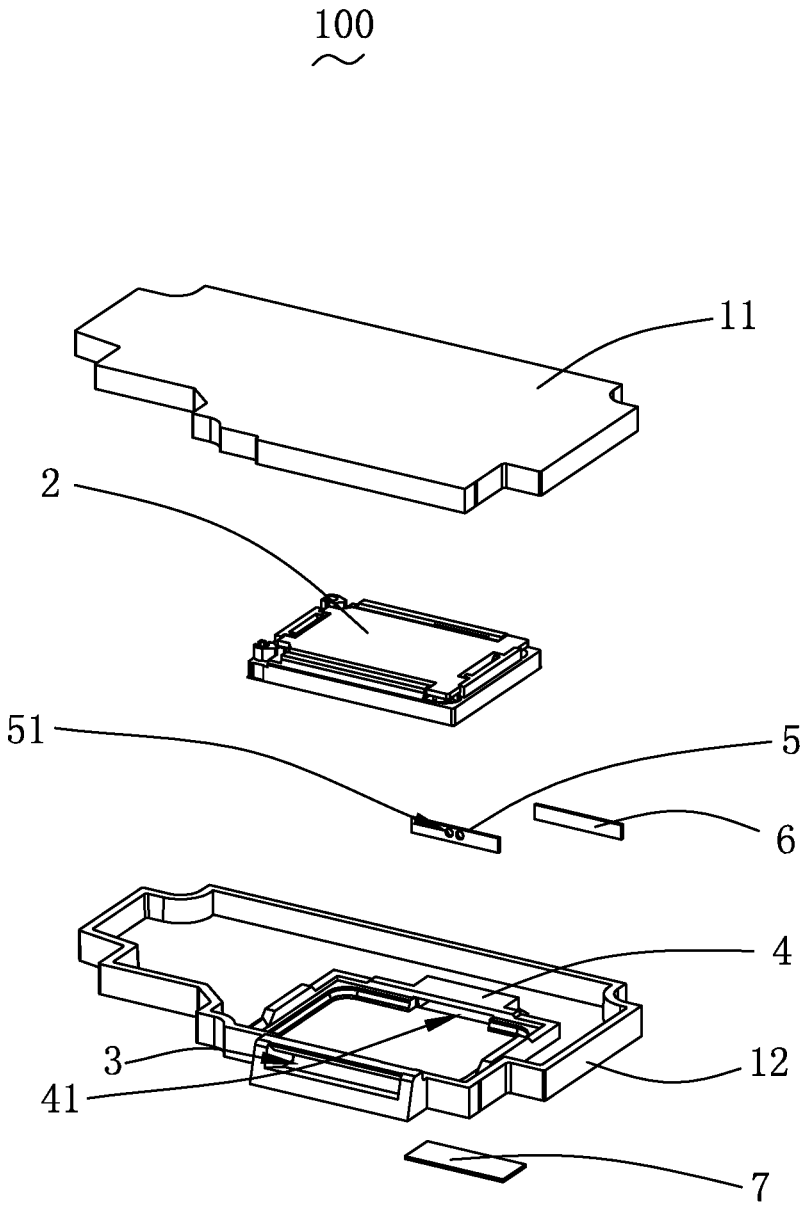
FIG. 2 is a partial exploded view of the three-dimensional structure of the speaker box shown in FIG. 1.
Figure 3:
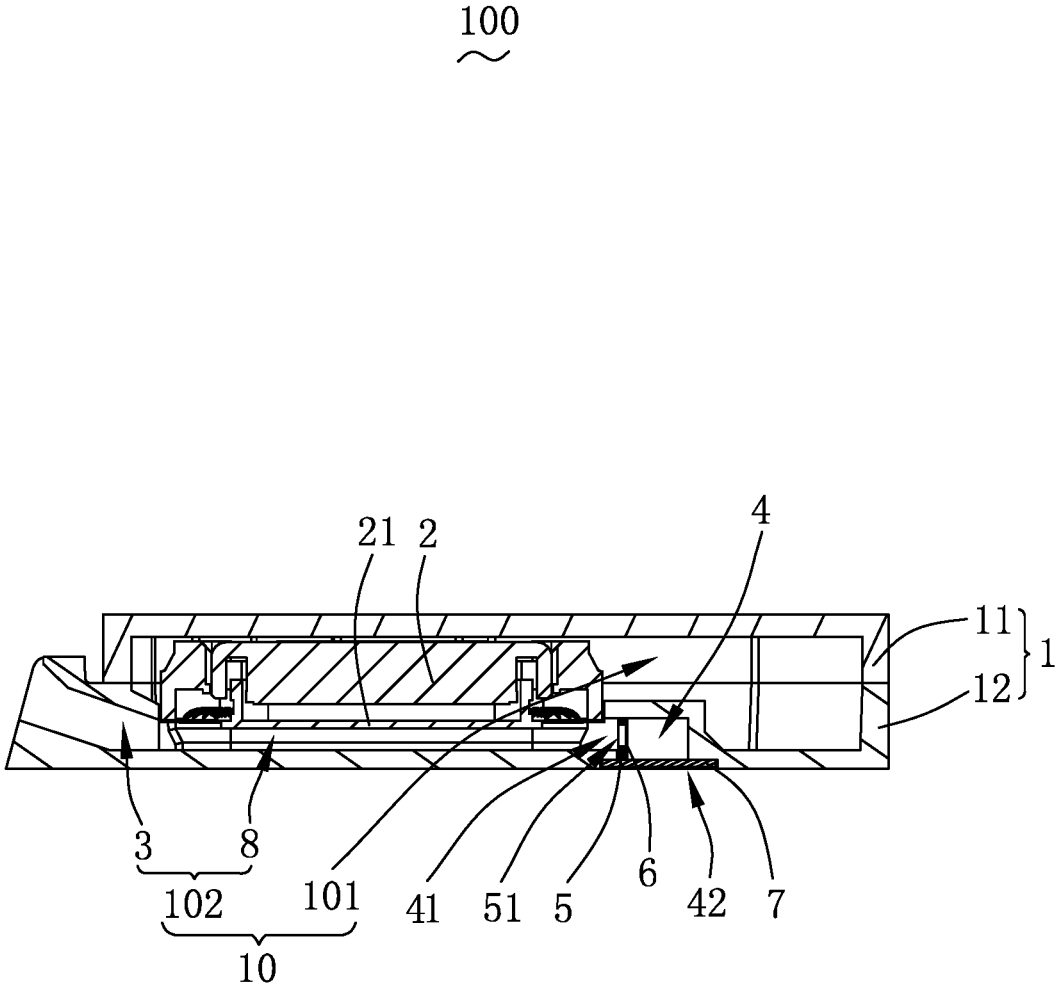
FIG. 3 is a cross-sectional diagram along the A-A line shown in FIG. 1.

Please also refer to FIG. 1 to FIG. 3, the present disclosure provides a speaker box 100, which comprises a shell 1 having a receiving space 10, a speaker 2, a sound guiding channel 3, an auxiliary sound cavity 4, a baffle 5, a sound absorber 6 and a cover plate 7.

The shell 1 can be either integrated into a whole structure or can be divided into a separate structure. For example, in this embodiment, the shell 1 comprises a lower cover 11 and an upper cover 12 engaging with the lower cover 11 for forming the receiving space 10 of the shell 1.

The speaker 2 is accommodated in the receiving space 10 of the shell 1, and the speaker 2 separates the receiving space 10 into a front sound cavity 8 and a rear cavity 101.

In this embodiment, the speaker 2 comprises a diaphragm 21 for vibration and radiating sound. The diaphragm 21 separates the receiving space 10 into the front sound cavity 8 and the rear cavity 101. In particular, the diaphragm 21 and the upper cover 12 are spaced apart to form the front sound cavity 8, and the diaphragm 21, the upper cover 11 and the lower cover 12 jointly enclose to form the rear cavity 101. The rear cavity 101 is used to improve the low frequency acoustic performance of the speaker box 100.

The sound guiding channel 3 is formed in the receiving space 10 of the shell 1. In this embodiment, the sound guiding channel 3 is disposed in the upper cover 12. The sound guiding channel 3 communicates the front sound cavity 8 with the outside, the front sound cavity 8 and the sound guiding channel 3 jointly form a front cavity 102 of the speaker box 100. The sound guiding channel 3 is used to form a side sound radiating structure of the front cavity 102.

The auxiliary sound cavity 4 is formed in the receiving space 10, for example, the auxiliary sound cavity 4 is disposed in the upper cover 12. The auxiliary sound cavity 4 is provided with a first through hole 41 communicating with the front cavity 102 and a second through hole 42 communicating with the outside.

The baffle 5 is provided with a channel 51 penetrating therethrough. The auxiliary sound cavity 4 is communicated with the front cavity 102 via the channel 51 of the baffle 5, and the auxiliary sound cavity 4 acts as a resonator cavity of the front cavity 102.

The sound absorber 6 is attached on one side of the baffle 5 away from the front cavity 102. In this embodiment, the material of the sound absorber 6 is sound-absorbing cotton, and the sound-absorbing cotton has the effect of absorbing sound. In particular, the sound absorber 6 is fixed on the baffle 5 and completely covers the channel 51. The baffle 5 isolates the anterior cavity 102 from the auxiliary sound cavity 4 and forms two cavities, so the auxiliary sound cavity 4 communicates with the front cavity 102 via the channel 51. That is, the auxiliary sound cavity 4 acts as part of the front cavity 102 and is used as a resonator of the front cavity 102.

On the one hand, the structure effectively increases the cavity volume of the front cavity 102 and improves the high frequency acoustic performance, and on the other hand, the structure design of the auxiliary sound cavity 4 is more flexible and varied, the restriction is small and the applicability is higher.

In particular, the auxiliary sound cavity 4 is communicated with the front sound cavity 8 via the channel 51. Of course, the auxiliary sound cavity 4 can also be communicated with the sound guiding channel 3 via the channel 51, which is also feasible, and the principle is the same.

In the present embodiment, the shape of the channel 51 is at least one of a rectangle, a triangle, and a circle, and the like. Of course, the shape of thereof is not limited thereto. In this embodiment, the number of the channel 51 is two and the two channels are spaced apart from each other.

The sound absorber 6 is attached and fixed to the baffle 5. After the design of the structure, the damping adjustment can be realized by adjusting the size of the channel 51 of the baffle 5 and the density of the sound absorber 6, so as to realize the high frequency acoustic performance adjustment of the speaker box 100, and increase the diversification and flexibility of its performance adjustment. More preferably, the sound absorber 6 is disposed on the side of the baffle 5 away from the front cavity 102.

Preferably, the structure can greatly increase the volume of the front cavity 102 under the same conditions, so as to improve its high frequency acoustic performance to a greater extent.

The cover plate 7 completely covers the second through hole 42 and is fixed to the upper cover 12. Thus, the auxiliary sound cavity 4 is enclosed to form a sealed cavity structure to act as a resonator for the front cavity 102, and to realize the high frequency acoustic performance adjustment of the front cavity 102. In the present embodiment, the material of the cover plate 7 is PET and is certainly not limited to this.

In this embodiment, the outer surface of the shell 1 is recessed to form a receiving groove, and the second through hole 42 extends through the receiving groove, and the cover plate 7 is fixed in the receiving groove. The shape of the second through hole 42 is a rectangle.

Compared with the relevant art, the speaker box of the present disclosure provides the auxiliary sound cavity 4 which communicates with the front cavity 102 in the shell 1, so that the auxiliary sound cavity 4 acts as a part of the front cavity 102 and acts as a resonant cavity, on the one hand, it effectively increases the cavity volume of the front cavity, improves the high frequency acoustic performance. On the other hand, the structure design of the auxiliary sound cavity is more flexible and diverse, and the applicability is higher, and the above structure can effectively reduce the Q value (quality factor value) and sensitivity of the high frequency resonance peak of the speaker box, which makes the acoustic performance of the speaker box more excellent.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker box, comprising:

a shell having a receiving space;

a speaker, which is accommodated in the receiving space, wherein the speaker comprises a diaphragm for vibrating and radiating sound, which separates the receiving space into a front sound cavity and a rear cavity;

a sound guiding channel, which is formed in the receiving space and communicates the front sound cavity with the outside and forms a front cavity with the front sound cavity;

an auxiliary sound cavity, which is formed in the shell and has a first through hole communicating with the front cavity and a second through hole communicating with the outside;

a baffle, which covers the first through hole and is fixed to the shell, wherein the baffle comprises a channel penetrating therethrough, the auxiliary sound cavity communicates with the front cavity via the channel to form a resonant cavity structure of the front cavity;

a cover plate, which covers the second through hole and is fixed to the shell;

a sound absorber is attached and fixed to the baffle and fully covers the channel.

2. The speaker box as described in claim 1, wherein the sound absorber is attached on one side of the baffle away from the front cavity.

3. The speaker box as described in claim 1, wherein the material of the sound absorber is sound absorbing cotton.

4. The speaker box as described in claim 1, wherein the shape of the channel is at least one of the rectangle, triangle and circle.

5. The speaker box as described in claim 1, wherein the number of the channel is two and the two channels are spaced apart from each other.

6. The speaker box as described in claim 1, wherein the material of the cover plate is PET.

7. The speaker box as described in claim 1, wherein the outer surface of the shell is accessed to form a receiving groove, and the second through hole extends through the receiving groove, and the cover plate is fixed in the receiving groove.

8. The speaker box as described in claim 1, wherein the auxiliary sound cavity communicates with the front sound cavity via the channel.

* * * * *